US008726426B2

(12) United States Patent
Blakely et al.

(10) Patent No.: US 8,726,426 B2
(45) **Date of Patent: *May 20, 2014**

(54) SHOULDER PAD COVER

(71) Applicant: Under Armour, Inc., Baltimore, MD (US)

(72) Inventors: Kyle Blakely, Baltimore, MD (US); Craig Lindemann, Elkton, MD (US)

(73) Assignee: Under Armour, Inc., Baltimore, MD (US)

( * ) Notice: Subject to any disclaimer, the term of this patent is extended or adjusted under 35 U.S.C. 154(b) by 31 days.

This patent is subject to a terminal disclaimer.

(21) Appl. No.: 13/769,595

(22) Filed: Feb. 18, 2013

(65) Prior Publication Data

US 2013/0152289 A1 Jun. 20, 2013

Related U.S. Application Data

(63) Continuation of application No. 12/749,205, filed on Mar. 29, 2010, now Pat. No. 8,397,315.

(60) Provisional application No. 61/165,198, filed on Mar. 31, 2009.

(51) Int. Cl.
*A41D 27/26* (2006.01)

(52) U.S. Cl.
USPC ..... 2/461; 2/115

(58) Field of Classification Search
USPC ..... 2/115, 461, 455, 459, 460, 462, 463, 2/467, 250
See application file for complete search history.

(56) References Cited

U.S. PATENT DOCUMENTS

| | | | | |
|---|---|---|---|---|
| 2,585,142 | A | 2/1952 | Levitt | |
| 2,586,515 | A | 2/1952 | Carvo | |
| 3,528,106 | A * | 9/1970 | Austin | 2/462 |
| 3,561,009 | A | 2/1971 | Huggins | |
| 4,441,211 | A | 4/1984 | Donzis | |
| 4,507,801 | A | 4/1985 | Kavanagh et al. | |
| 4,675,917 | A | 6/1987 | Valli | |
| 4,698,849 | A | 10/1987 | Mitchell et al. | |
| 4,716,600 | A | 1/1988 | van Beek | |
| 4,810,559 | A | 3/1989 | Fortier et al. | |
| 5,349,704 | A | 9/1994 | Masters | |
| 5,621,914 | A | 4/1997 | Ramone et al. | |
| 5,983,394 | A | 11/1999 | Joo | |
| 6,484,325 | B1 | 11/2002 | Lazarus | |
| 8,397,315 | B2 * | 3/2013 | Blakely et al. | 2/461 |
| 2002/0022433 | A1 * | 2/2002 | Yeung et al. | 450/70 |
| 2006/0080762 | A1 | 4/2006 | Kobren et al. | |
| 2006/0272071 | A1 | 12/2006 | Mickle | |
| 2007/0050886 | A1 | 3/2007 | Brassill | |
| 2009/0271916 | A1 | 11/2009 | Harris | |

* cited by examiner

*Primary Examiner* — Khoa Huynh
*Assistant Examiner* — Anna Kinsaul
(74) *Attorney, Agent, or Firm* — Maginot Moore & Beck LLP

(57) ABSTRACT

A garment made of a compression fabric is provided to serve as a shoulder pad covering. The garment includes a torso portion having a front portion connected to a back portion. The torso portion defines a torso opening, a neck opening, a left arm passage, and a right arm passage. A left shoulder portion is connected to the torso portion adjacent to the left arm passage. The left shoulder portion includes a left shoulder cap pocket. A right shoulder portion is connected to the torso portion adjacent to the right arm passage. The right shoulder portion includes a right shoulder cap pocket. A left epaulette passage is positioned between the neck opening and the left shoulder portion. A right epaulette passage is positioned between the neck opening and the right shoulder portion.

20 Claims, 11 Drawing Sheets

SHOULDER PAD COVER

CROSS-REFERENCE TO RELATED APPLICATIONS

This application is a continuation of U.S. patent application Ser. No. 12/749,205, filed Mar. 29, 2010, which claims priority from U.S. Provisional Patent Application No. 61/165,198, filed Mar. 31, 2009, the contents of which are incorporated herein by reference in their entirety.

FIELD

This application relates to the field of protective padding for athletes, and particularly to arrangements for protecting jerseys from pads and securing pads to the body of the athlete.

BACKGROUND

Athletes often wear protective padding during sporting events. For example, American football and hockey players typically wear shoulder pads and other pads that must be secured to their body underneath a jersey. The pads include a hard outer shell with pads provided under the shell against the athlete's body. These pads protect the user, as referred to as the athlete herein, from repeated impacts encountered during play.

Straps and lacings are typically used to secure the shoulder pads to the athlete's body. The straps usually extend under the athlete's arms from the front chest portion to the rear back portion on each side of the athlete. A buckle may be used to adjust the length of each strap and tighten the pads on the athlete. The lacings are usually provided on the front of the pads to draw left and right chest portions together.

While the straps and lacings do an adequate job of securing the shoulder pads to the athlete's body, the straps and other adjustment mechanisms used to secure the pads to the body can be difficult to manage. Accordingly, it can be difficult and time consuming to properly adjust the straps and lacings such that the shoulder pads are properly secured on the athlete. Furthermore, the straps may be uncomfortable to the athlete when wearing the pads, since tightened straps will tend to cut into the body of the athlete and rub against the skin. The buckles or other adjustment mechanisms used to adjust the straps may also be uncomfortable to the wearer of the pads if these objects are in close proximity to the skin.

In addition to comfort issues, traditional football shoulder pads tend to damage the athlete's jersey. In particular, the hard outer shell of the shoulder pads as well as the buckles and other coarse surfaces rub against the athlete's jersey. The resulting friction between the jersey and the pads tends to result in abrasions and tears in the jersey over time.

In order to avoid abrasion between the jersey and the shoulder pads, jerseys are often loosely fitted on the athlete. However, in many contact sports, such as American football, this is a disadvantage, as a loose jersey may be easily grasped by an opponent and used to tackle the athlete. While close fitting jerseys are available, such as jerseys made with compression fabric, these close fitting jerseys tend to wear faster than the loose fitting jerseys, and many teams choose to utilize looser jerseys in an attempt to extend jersey life.

In view of the foregoing, it would be desirable to provide a device for quickly and easily securing shoulder pads to an athlete. It would also be desirable if such device was relatively simple and also comfortable for the athlete. Furthermore, it would be advantageous if such device could serve to limit wear and tear to the athlete's jersey over time. Additionally, it would be desirable if the device could facilitate the use of a tighter jersey on the athlete without resulting in increased jersey wear. While it would be advantageous to provide one or more of these or other advantageous features as may be apparent to those reviewing this disclosure, it should be recognized that the teachings disclosed herein extend to those embodiments which fall within the scope of any appended claims, regardless of whether they accomplish one or more of the above-mentioned advantages.

SUMMARY

A garment comprises a torso portion, a left shoulder pocket and a right shoulder pocket. The torso portion includes a left opening and a right opening. The left opening provides a left arm passage from an interior to an exterior of the garment and the right opening provides a right arm passage from the interior to the exterior of the garment. The left opening is located in a left underarm area of the torso portion and the right opening is located in a right underarm area of the garment. A left shoulder pocket is connected to the torso portion above the left underarm area. The left shoulder pocket includes an upper portion, a lower portion, and a pocket opening between the upper portion and the lower portion at a right side of the left shoulder pocket. A right shoulder pocket is connected to the torso portion above the right underarm area. The right shoulder pocket includes an upper portion, a lower portion, and a pocket opening between the upper portion and the lower portion at a left side of the right shoulder pocket.

When used in association with athletic shoulder pads, the shoulder pad covering improves shoulder pad fit and reduces slipping by pulling the shoulder pads into the human body from all angles. In addition, the shoulder pad covering provides a protective barrier between the shoulder pads and an outer jersey worn by the athlete.

In at least one exemplary embodiment a method of securing shoulder pads to a wearer includes placing the shoulder pads on the shoulders of the wearer, the shoulder pads including a main portion, a left shoulder cap pivotably coupled to the main portion, and a right shoulder cap pivotably coupled to the main portion. The method further includes placing a shoulder pad cover over the shoulder pads such that the wearer's left arm extends through a left opening in the shoulder pad cover, the wearer's right arm extends through a right opening in the shoulder pad cover, and a torso portion of the shoulder pad cover substantially covers the main portion of the shoulder pads. The method further includes inserting the left shoulder cap of the shoulder pads into a left shoulder pocket of the shoulder pad cover, and inserting a right shoulder cap of the shoulder pads into the right shoulder pocket of the shoulder pad cover.

In at least one exemplary embodiment, a garment arrangement comprises shoulder pads and a shoulder pad cover. The shoulder pads include a main portion, a left shoulder cap pivotably coupled to the main portion, and a right shoulder cap pivotably coupled to the main portion. The shoulder pad cover comprises a torso portion, a left shoulder pocket and a right shoulder pocket. The torso portion includes a torso opening, a neck opening, a left arm opening, and a right arm opening. The left shoulder pocket is connected to the torso portion adjacent to the left arm opening. The left shoulder pocket includes an upper portion, a lower portion, and an opening configured to receive the left shoulder cap of the shoulder pads between the upper portion and the lower portion. The right shoulder pocket is connected to the torso portion adjacent to the right arm opening. The right shoulder pocket includes an upper portion, a lower portion, and an opening configured to receive the right shoulder cap of the shoulder pads between the upper portion and the lower portion.

The above described features and advantages, as well as others, will become more readily apparent to those of ordinary skill in the art by reference to the following detailed description and accompanying drawings. While it would be desirable to provide a shoulder pad cover that provides one or more of these or other advantageous features, the teachings disclosed herein extend to those embodiments which fall within the scope of the appended claims, regardless of whether they accomplish one or more of the above-mentioned advantages or include the above-mentioned features.

DESCRIPTION

Figure 11:
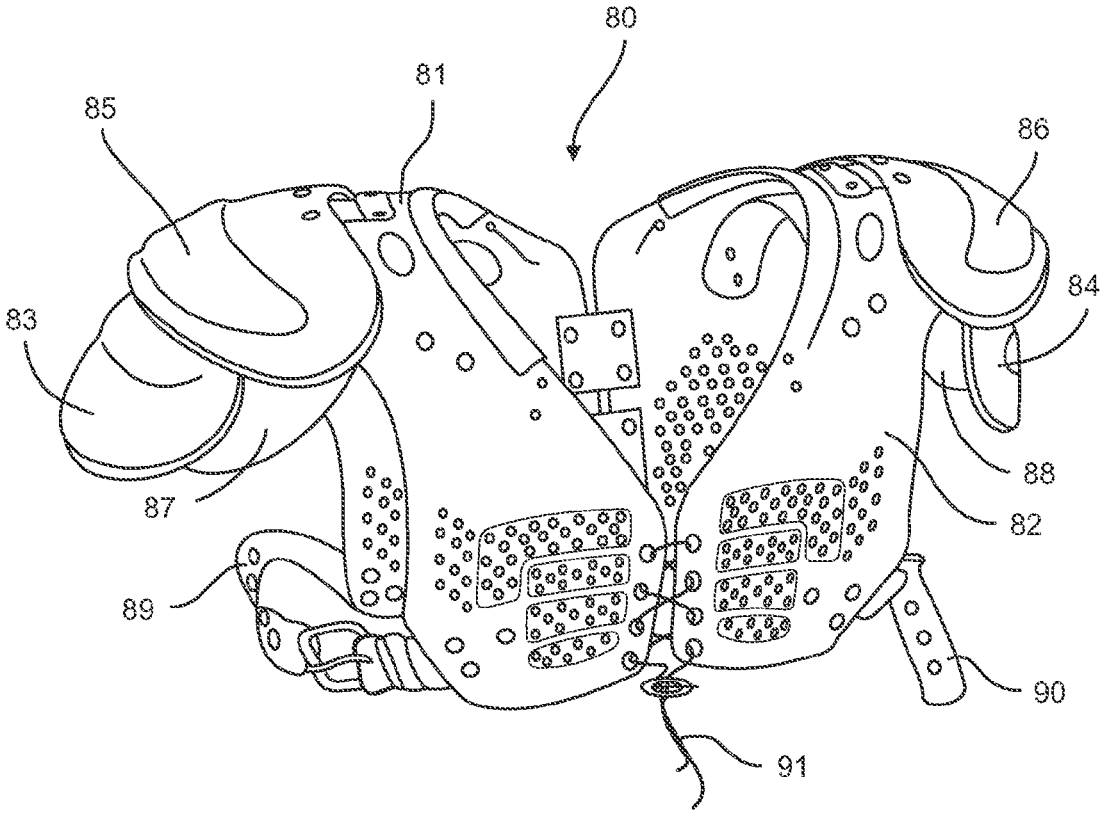
FIG. 11 PRIOR ART
FIG. 11 a typical prior art shoulder pad arrangement for use with the shoulder pad cover of FIG. 1.

A set of typical prior art shoulder pads 80 that may be used in association with the shoulder pad cover disclosed herein is shown in FIG. 11. The shoulder pads 80 generally comprise a plurality of hard shell components with soft subpads provided underneath the hard shell. The hard shell components are generally comprised of a hard plastic material and the soft subpads are generally comprised of a soft foam or similar material. The hard shell components include a right main arch 81, a left main arch 82, a right shoulder cap 83, a left shoulder cap 84 (the right and left shoulder caps may sometimes be referred to as cowls), a right epaulette 85, and a left epaulette 86. The soft subpads comprise a right deltoid subpad assembly 87 and a left deltoid subpad assembly 88. A right strap 89 extends between the front of the right main arch 81 and the rear of the right main arch. Similarly, a left strap 90 extends between the front of the left main arch 82 and the rear of the right main arch. Laces 91 may be used to connect the front of the right main arch 81 and the left main arch 82. Both shoulder caps 83, 84 and the epaulettes 85, 86 are pivotably connected to a main portion of the shoulder pads, and particularly the respective main arches 81, 82, such that the shoulder caps and epaulettes may be pivotably rotated upward.

Figure 1:
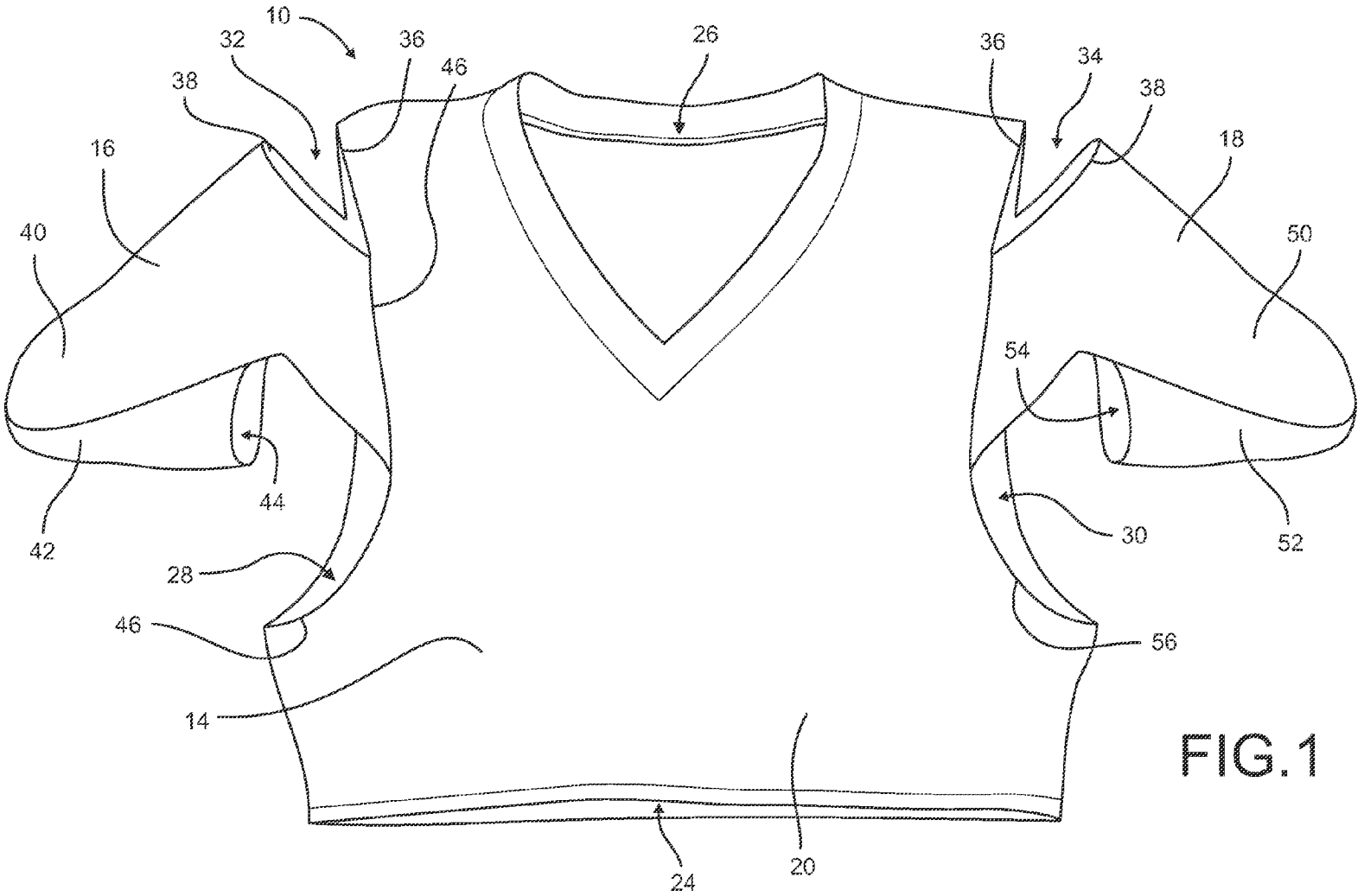
FIG. 1 shows a front view of a shoulder pad cover.
Figure 2:
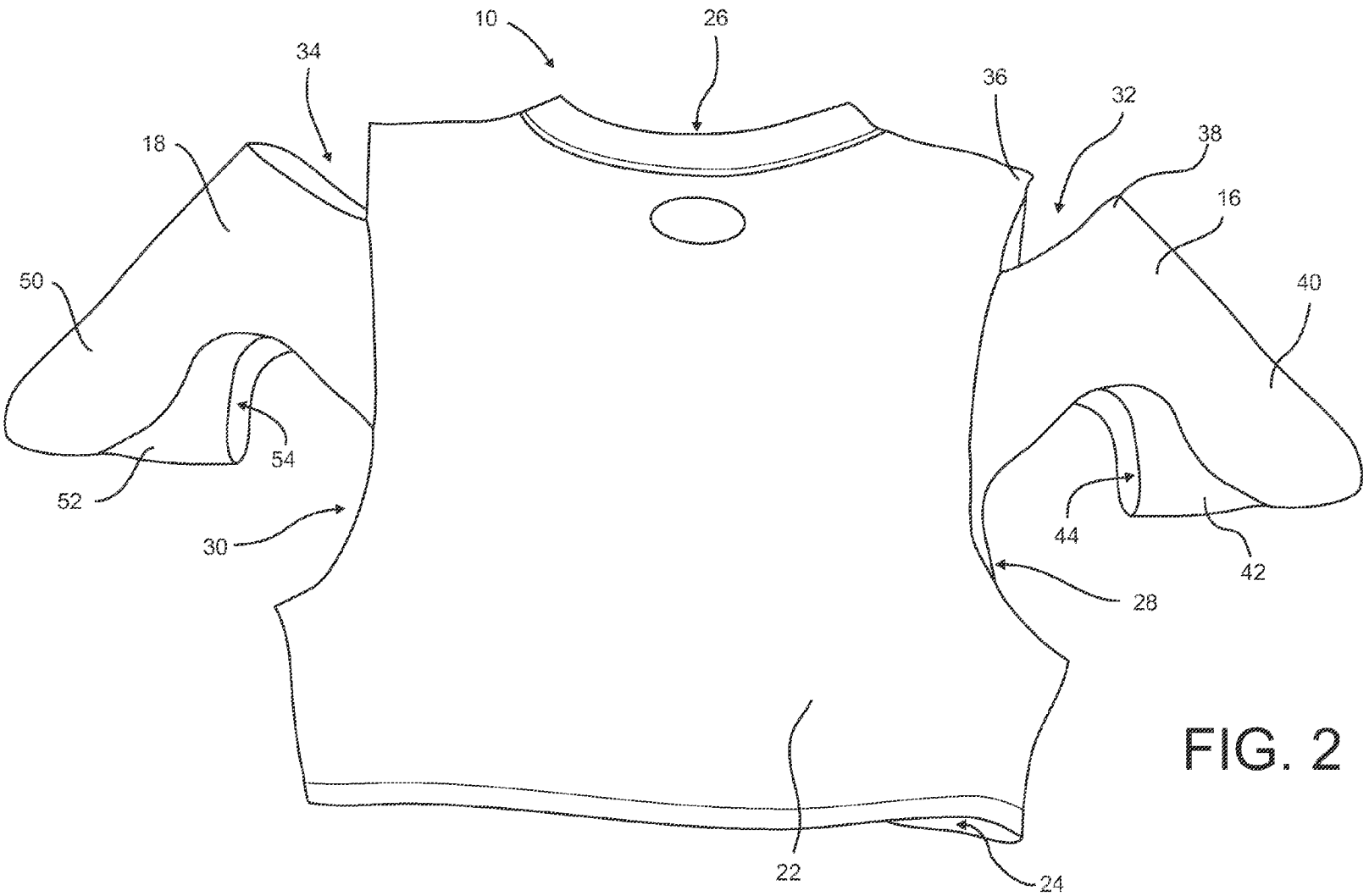
FIG. 2 shows a rear view of the shoulder pad cover of FIG. 1.

FIGS. 1-6 show a first exemplary embodiment of a shoulder pad cover 10 for use in association with shoulder pads 80. FIGS. 1 and 2 show the shoulder pad cover 10 without the shoulder pads 80, and FIGS. 3-6 show the shoulder pad cover 10 positioned on a human torso 12 carrying shoulder pads 80.

The shoulder pad cover 10 in this exemplary embodiment is provided as a garment comprised of a fabric with a high modulus of elasticity, such as elastane. These fabrics are often referred to as compression fabrics. The material may be a polyester/elastane fabric with moisture-wicking properties. For example, the fabric may comprise 5 oz/yd.sup.2 microdenier polyester/elastane warp knit tricot fabric that will wick moisture from the body and include 76% 40 denier dull polyester and 24% 55 denier spandex knit. The high elastane content allows for proper stretch and support. The fabric may be a tricot construction at a 60" width. The mean warp stretch may be 187% at 10 lbs of load, and the mean width stretch may be 90% at 10 lbs of load. This fabric also may have a wicking finish applied to it. Although the foregoing fabric is given as an example, it will be appreciated that any other fabric or other materials known in the art may be used to construct the shoulder pad cover 10, including compression fabrics and non-compression fabrics. Examples of such fabrics include, but are not limited to, knit, woven and non-woven fabrics comprised of nylon, polyester, cotton, elastane, blends thereof and the like. While these are but a few examples of the fabrics and materials that may be used to construct the shoulder pad cover 10, it will be recognized that any other fabric or material may also be used in different embodiments of the shoulder pad cover 10.

As shown in FIGS. 1 and 2, the shoulder pad cover 10 generally includes a torso portion 14, a right shoulder portion 16, and a left shoulder portion 18. As explained in further detail below, the shoulder pad cover 10 is designed to cover the shoulder pads 80 and help retain the shoulder pads 80 on the human torso 12.

The torso portion 14 of the shoulder pad cover 10 includes a front portion 20 connected to the rear portion 22 to form a shirt-like garment. The front portion 20 and rear portion 22 may be joined at a plurality of seams using stitching, adhesives, or any of various other methods known in the art. Alternatively, the front and rear portions 20 and 22 may be integrally formed from a unitary piece of fabric, or the seams may be placed elsewhere in the garment without clearly defining the front and rear portions of the garment. For example, a seam may be placed along the middle of the rear portion 22. Accordingly, while the exemplary embodiments disclosed herein may include different portions formed by separated pieces of fabric joined at a seam, it will be recognized that the disclosure is not limited to such exemplary embodiments. In other exemplary embodiments different portions of the garment may be integrally formed from a unitary piece of fabric and various seams in the garment may be located arbitrarily without distinguishing one portion of the garment from another.

Figure 3:
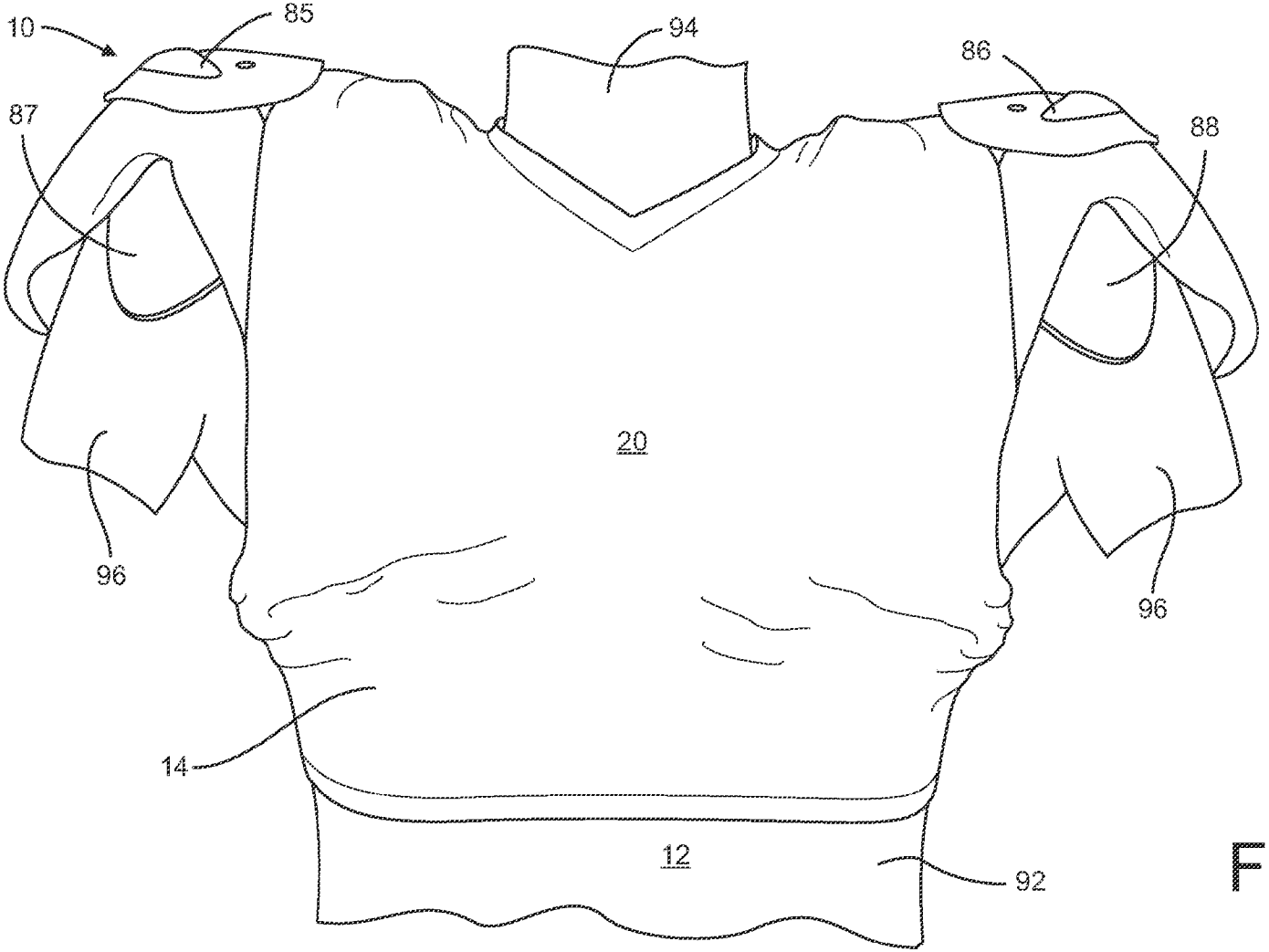
FIG. 3 shows the shoulder pad cover of FIG. 1 positioned on a human torso wearing shoulder pads.
Figure 4:
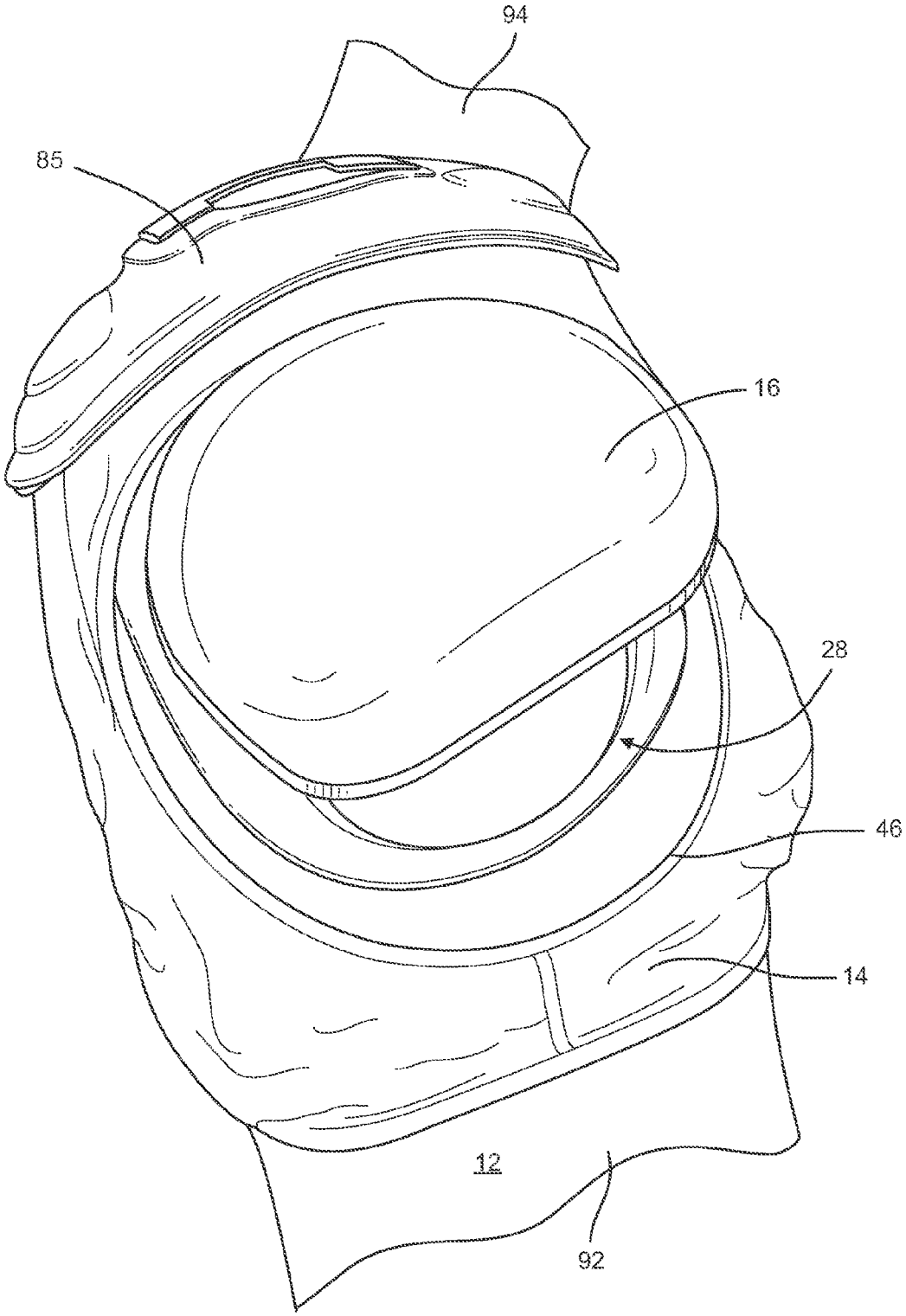
FIG. 4 shows a side view of the shoulder pad cover of FIG. 1.

As best seen in FIGS. 1 and 2, a plurality of openings are formed in the torso portion 14 including a torso opening 24, a neck opening 26, arm passages 28 and 30 and epaulette passages 32 and 34. The torso opening 24 is formed at the bottom of the garment and is designed to snugly fit around a human or athlete's abdomen 92. To help ensure a snug fit around the shoulder pads 80, the torso opening may include an elastic band stitched or otherwise provided at the bottom of the shoulder pad cover 10. As shown in FIGS. 3 and 4, this elastic band serves to pull the bottom of the shoulder pad cover 10 around the shoulder pads 80 at the bottom of the garment such that the garment provides a snug fit around the athlete's abdomen 92.

The neck opening 26 is a center opening positioned between the epaulette passages 32 and 34 on the shoulder pad cover 10 and opposite the torso opening 24. The neck opening 26 is sufficient in size to allow passage of the athlete's head through the neck opening when the opening is stretched. Accordingly, the neck opening 26 provides a neck passage from the interior to the exterior of the shoulder pad cover 10. The neck opening 26 may be a crew neck, v-neck or other arrangement. The neck opening 26 is large enough in size to comfortably fit the athlete, but small enough in size such that the fabric of the shoulder pad cover 10 substantially covers the main arches 81, 82 of the shoulder pads 80.

Figure 5:
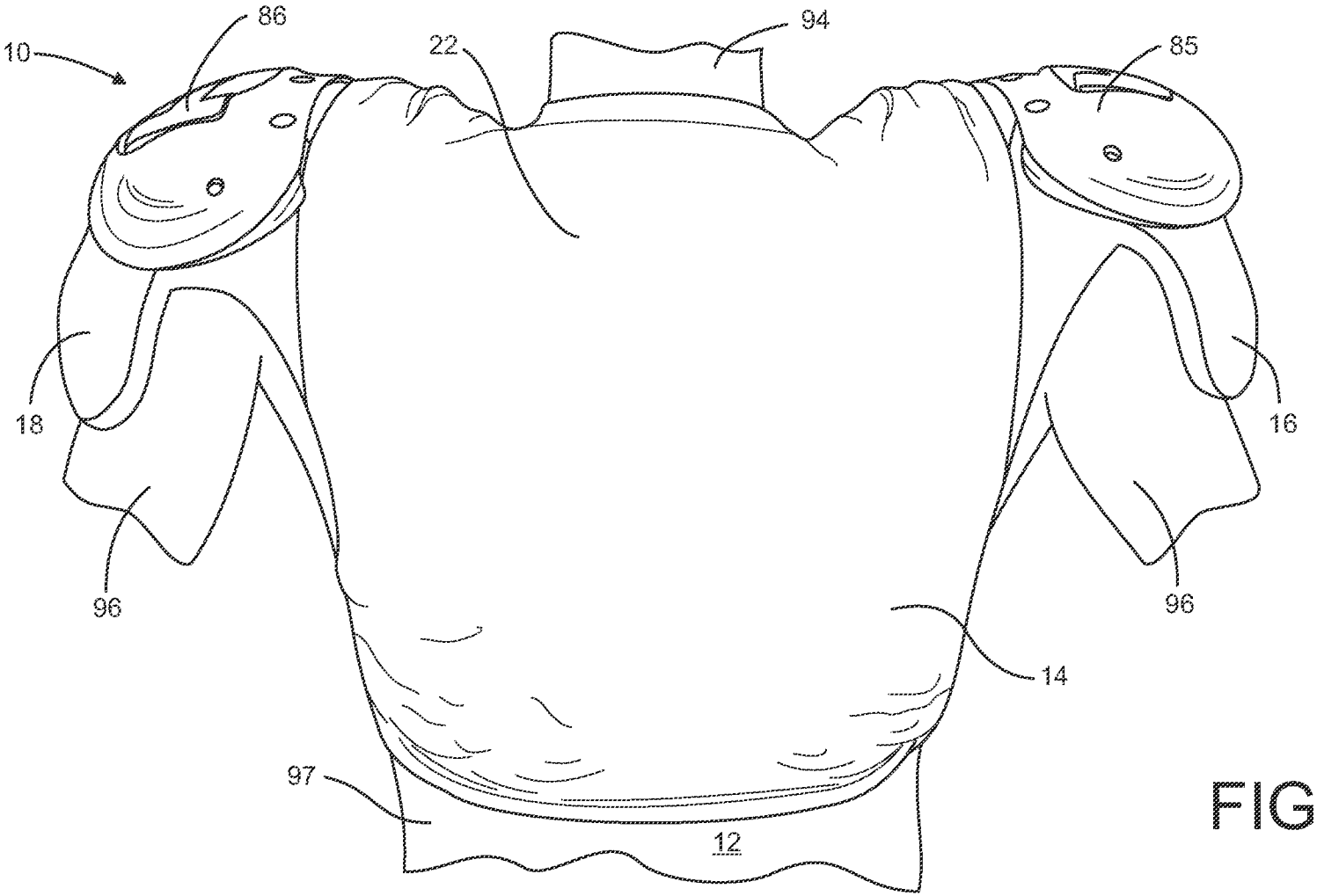
FIG. 5 shows a rear view of the shoulder pad cover of FIG. 1.

The right arm passage 28 and 30 are positioned between the front portion 20 and rear portion 22 of the shoulder pad cover 10. The arm passages 28 and 30 extend from a middle or lower part of the shoulder pad cover 10 to the shoulder portions 16 and 18 of the shoulder pad cover 10. As best seen in FIGS. 3-5, the arm passages 28 and 30 provide openings that lead from an interior to an exterior of the shoulder pad cover 10 and are sufficiently large to easily receive the athlete's arms 96 without restricting movement of the arms. The arm passages 28 and 30 provide for a sleeveless garment 10 since the arm passages do not lead to sleeves in the shoulder pad cover 10. While the arm passages 28 and 30 are adjacent to shoulder portions 16 and 18, the shoulder portions 16 and 18 do not provide sleeves on the garment in the disclosed exemplary embodiment. Instead, the arm passages 28 and 30 are generally provided in a left and right underarm area and a left and right shoulder area which partially covers the deltoid muscle regions of an athlete wearing the garment. However, it will be recognized that in other exemplary embodiments the shoulder pad cover 10 may include sleeves such that the arm passages 28 and 30 feed into the sleeves.

Figure 6:
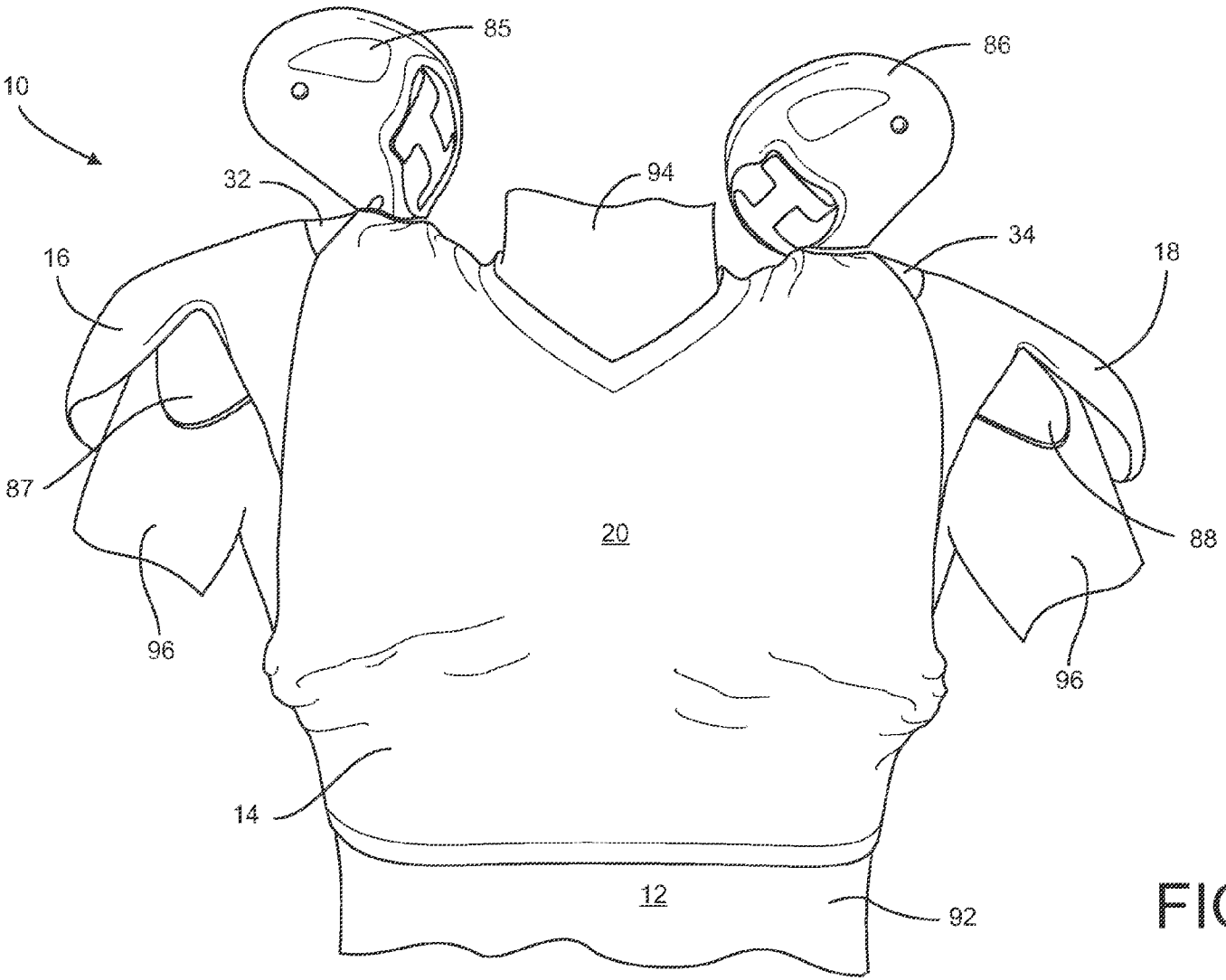
FIG. 6 shows a front view of the shoulder pad cover of FIG. 1 with the epaulettes of the shoulder pad in an upright position.

The right epaulette passage 32 is positioned above the right arm passage 28 between the neck opening 26 and the right shoulder portion 16. Similarly, the left epaulette passage 34 is positioned above the left arm passage 30 between the neck opening 26 and the left shoulder portion 18. Each epaulette passage 32, 34 is elongated with opposing convex edges that result in a curved lens shape. Each epaulette passage 32, 34 is configured to pass an epaulette 85, 86 on the shoulder pads 80 such that the epaulette is provided above the respective shoulder portion 16 or 18. The edges of each epaulette passage 32, 34 are defined along a first seam 36 provided along an upper edge of the torso portion 14 and a second seam 38 provided along upper edge of the respective shoulder portion 16, 18. FIG. 6 shows that the epaulettes 85, 86 remain pivotable on the shoulder pads 80 when the shoulder pad cover 10 is used in association with the shoulder pads 80.

With continued reference to FIGS. 1-6, the right shoulder portion 16 of the shoulder pad cover 10 is adjacent to the right arm passage 28 and is connected to the torso portion 14 along a seam 46 that defines the right arm passage 28. The right shoulder portion 16 includes an upper portion provided by upper panel 40 and a lower portion provided by lower panel 42 that are joined together along a right side and are open on a left side. Accordingly, the right shoulder portion 16 provides a right shoulder pocket 44 having an opening at the left side of the pocket. This opening is designed and dimensioned to pass the right shoulder cap 83 of the shoulder pads 80. Similarly, the right shoulder pocket 44 is designed and dimensioned to receive the right shoulder cap 83 of the shoulder pads 80 when the fabric forming the right shoulder pocket 44 is stretched around the right shoulder cap 83. When an athlete wears the shoulder pad cover, the lower panel 42 of the right shoulder portion 16 is positioned such that it lies above and partially covers the deltoid muscles of the athlete.

The left shoulder portion 18 is a mirror image of the right shoulder portion 16. Accordingly, the left shoulder portion includes a left upper panel 50 and a left lower panel 52 that form a left pocket 54 configured to receive the left shoulder cap 84 of shoulder pads 80.

Figure 7:
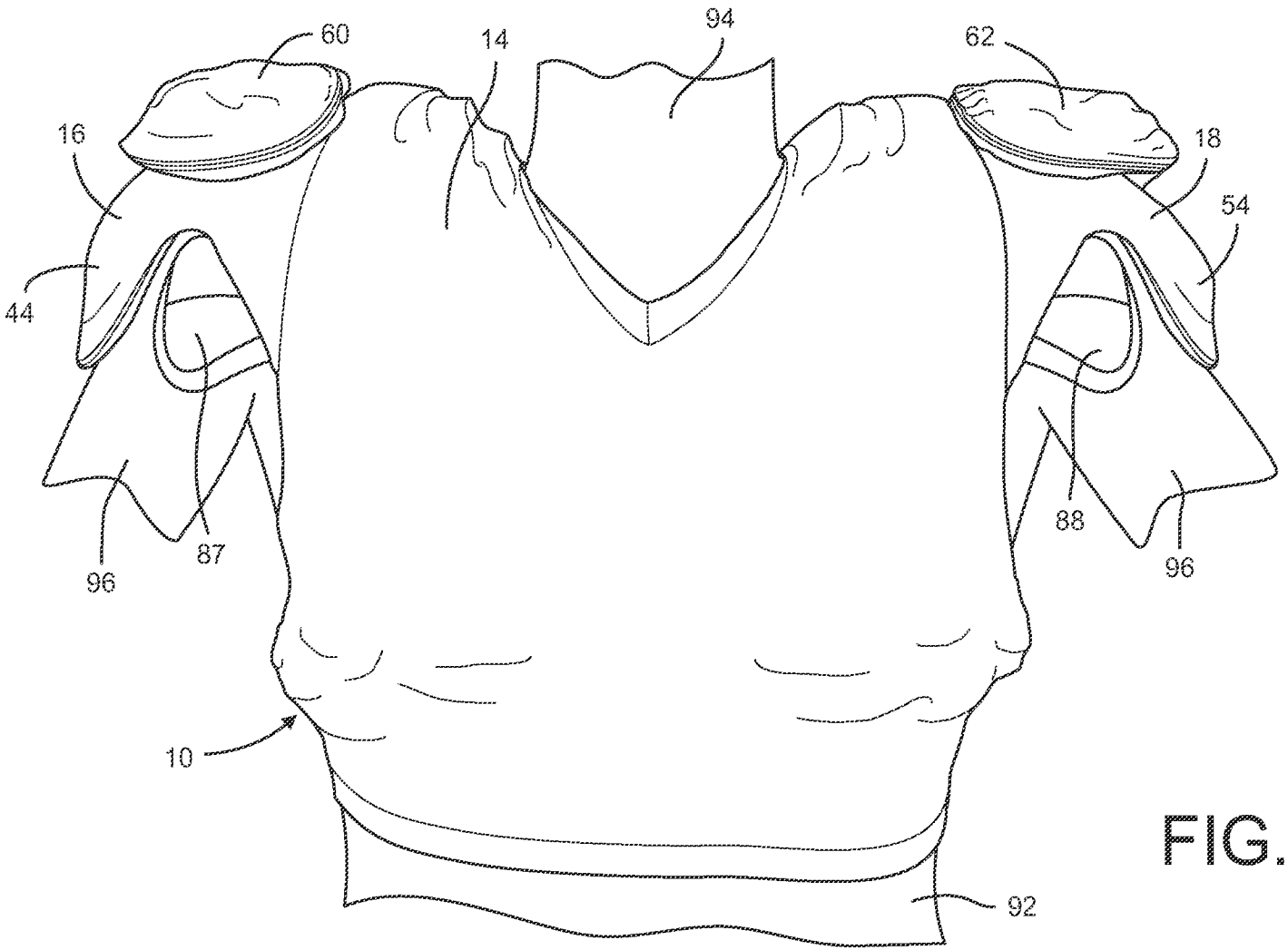
FIG. 7 shows an alternative exemplary embodiment of the shoulder pad cover of FIG. 1 wherein the shoulder pad cover further comprises epaulette pockets.
Figure 8:
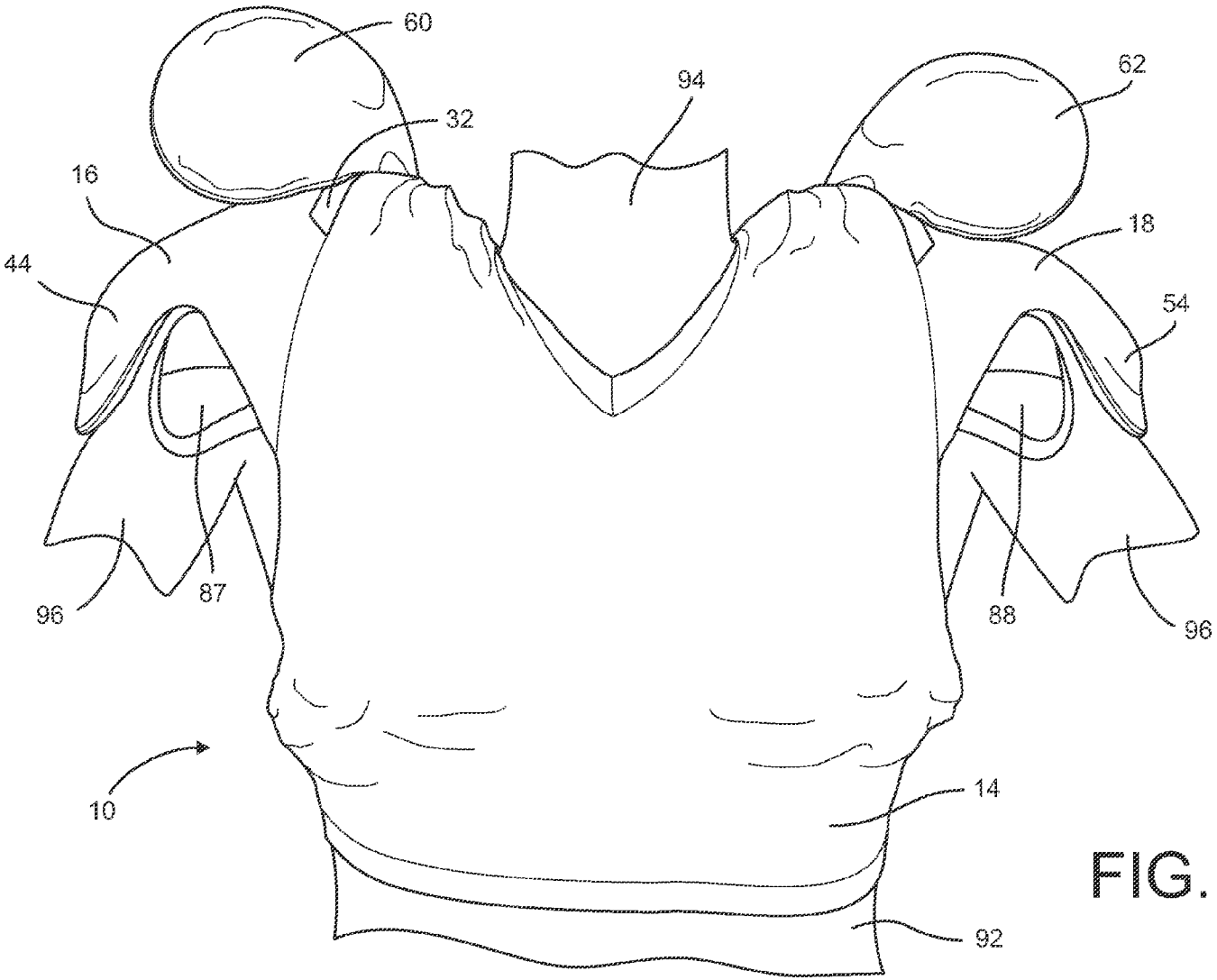
FIG. 8 shows the shoulder pad cover of FIG. 7 with the epaulettes of the shoulder pad in an upright position.

With reference now to FIGS. 7 and 8, an alternative exemplary embodiment of the shoulder pad cover 10 is shown wherein the shoulder pad cover 10 further comprises right and left epaulette pockets 60 and 62. Right and left epaulette pockets 60 and 62 are similar in construction, and only the right epaulette pocket 60 is explained herein. The right epaulette pocket 60 is provided adjacent to the right epaulette passage 32 and includes an opening to the pocket in its lower side. The right epaulette pocket 60 is connected to the torso portion 14 between the neck opening 26 and the right epaulette passage 32. In the disclosed exemplary embodiment the right epaulette pocket 60 is not connected to the opposite side of the right epaulette passage 32 on the right shoulder portion 16. Accordingly, the right epaulette pocket 60 serves as a flap that may be moved up and down. When in an up position, the right epaulette pocket 60 exposes the right epaulette passage 32; when in a down position, the right epaulette pocket 60 substantially covers the right epaulette passage 32. The right epaulette pocket 60 is designed and dimensioned to receive the right epaulette 85 of the shoulder pads such that it substantially covers the right epaulette 85. Because the right epaulette pocket 60 is moveable, it does not restrict the right epaulette 85 from moving up and down when positioned in the pocket. While the epaulette pocket 60 has been described as attached to only the inner side of the epaulette passage 32, in other exemplary embodiments, the epaulette pocket 60 could be configured to completely cover the epaulette passage 32 such that the right epaulette passage 32 leads directly into the right epaulette pocket 60. Alternatively, the right epaulette pocket 60 could be connected only to the right shoulder portion 16 with the opening to the pocket on an upper side of the pocket instead of the lower side of the pocket.

Figure 9:
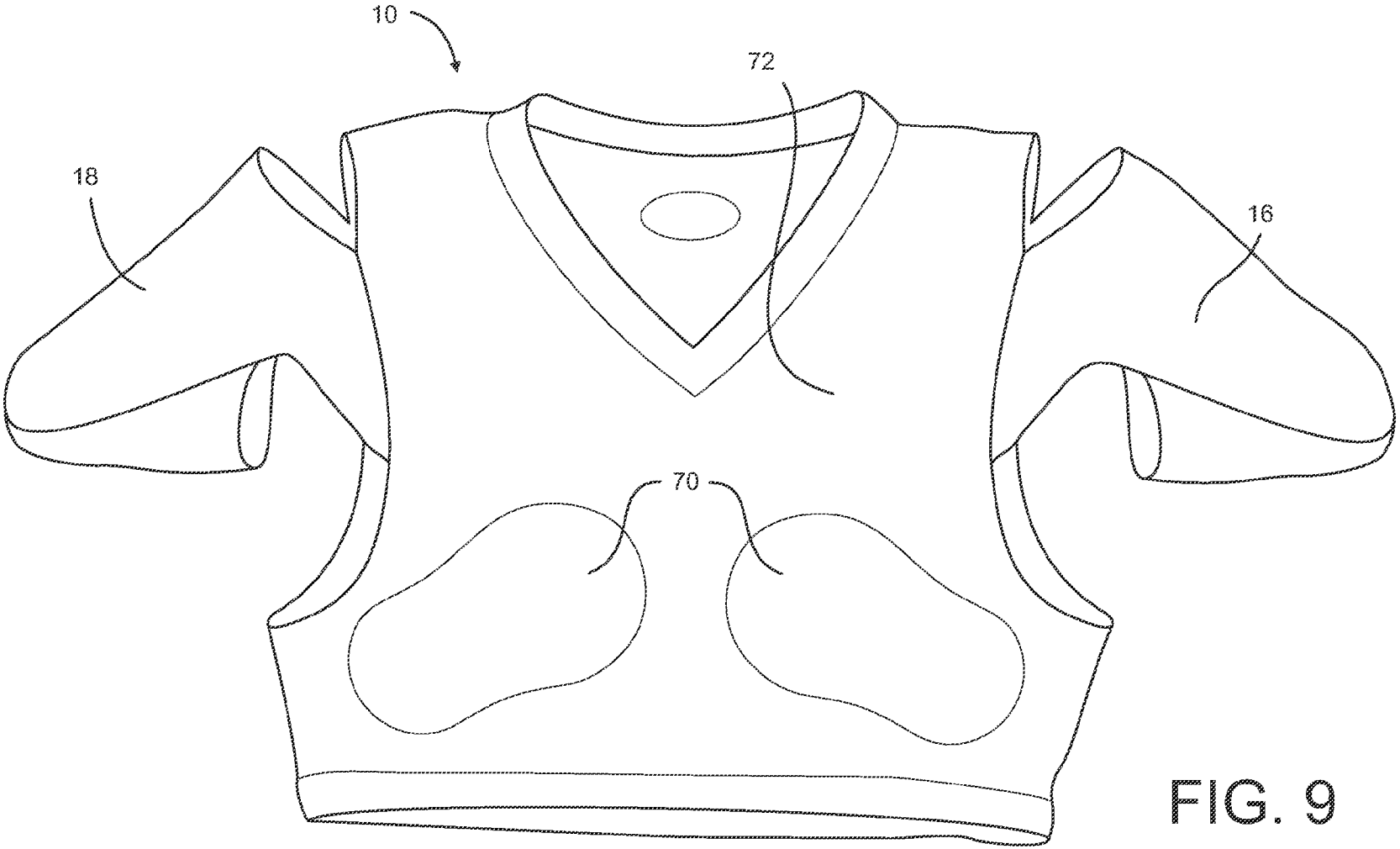
FIG. 9 shows an inside-out view of the shoulder pad cover of FIG. 1 to show protective barriers provided on the interior of the shoulder pad cover.

With reference now to FIG. 9 an inside-out view of the shoulder pad cover 10 of FIG. 1 is shown. A plurality of protective barriers 70 are provided on the interior surface 72 of the shoulder pad cover 10. The protective barriers 70 provide an area of increased durability on the interior surface 72 of the shoulder pad cover 10. Thus, the protective barriers reinforce the shoulder pad cover 10 and protect the shoulder pad cover 10 from wear that may result from continuous contact with the hard outer shell portions of shoulder pads, the buckles or other metal or hard members on the shoulder pads. In at least one exemplary embodiment, the protective barriers 70 are provided by an abrasion-resistant film located on the interior of the shoulder pad cover 10, as shown in FIG. 9. The protective barriers 70 may be comprised of, for example, a polyurethane gel, an elastomer or other durable material. However, it will be recognized that any of various other materials may be used to provide the protective barriers. While the protective barriers 70 are shown as relatively large rectangular barrier pads in FIG. 9, the protective barriers may also be provided in other forms and shapes.

Figure 10:
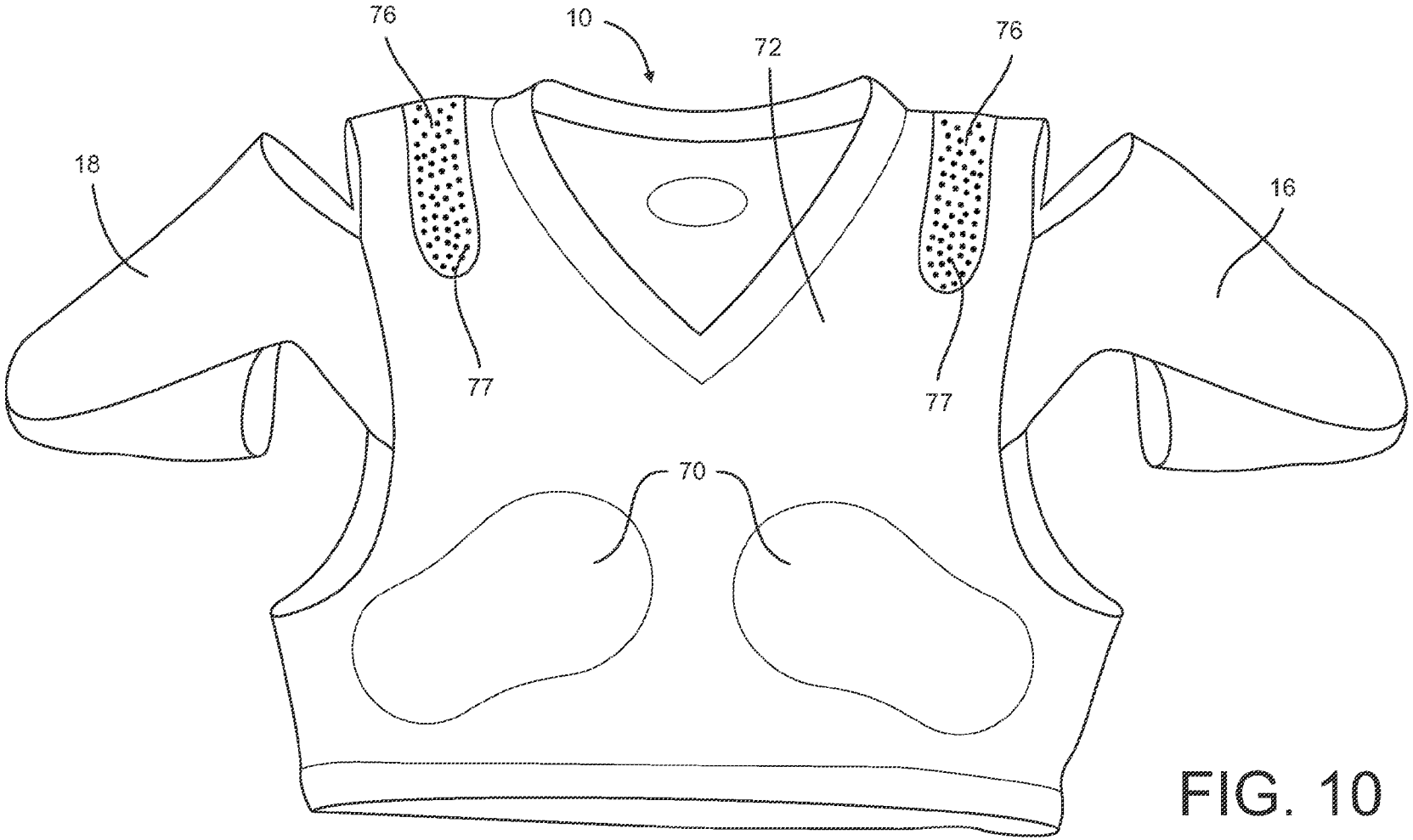
FIG. 10 shows an inside-out view of an alternative exemplary embodiment of the shoulder pad cover of FIG. 9 also including gripping members on the interior of the shoulder pad cover.

FIG. 10 shows an alternative exemplary embodiment of the interior of the garment of FIG. 9 wherein the interior of the garment also includes a plurality of gripping members 76 providing a greater coefficient of friction than the fabric of the garment when in contact with the shoulder pads. The gripping members 76 are shown as friction pads covering a relatively large area near the shoulder portion on the interior of the shoulder pad cover 10. The gripping members 76 may further comprise a plurality of individual bumps 77 provided on the pad. The gripping members 76 may be provided by a tackifying ink or the like applied to the interior of the shoulder pad cover 10. The tackifying ink may be applied to shoulder pad cover 10 using a screen-printing process of any of various other application processes. In any event, the tackiness of gripping members 76 provides a high coefficient of friction between the gripping members 76 and the hard shell portions of the shoulder pads 80 such that the shoulder pad cover 10 does not easily slide off of the hard shell portions of the shoulder pads 80. The tackifying ink may be, for example, a PVC (polyvinyl chloride) based printing ink, know as plastisol. Plastisol inks usually also contain plasticizers to aid in the screen printing process. Plasticizers may be present because PVC alone is a very rigid plastic and may have to be softened or plasticised to give it a significant degree of flexibility. While the gripping members 76 in FIG. 10 are shown as pads with a plurality of bumps 77 provided thereon, friction members may also be provided in other forms and shapes, such as an array of relatively small individual friction bumps provided directly on the shoulder pad cover 10 without a base pad. Furthermore, although the gripping members 76 are shown in FIG. 10 on shoulder portions of the shoulder pad cover 10, they may also be provided on other areas on the interior surface of the shoulder pad cover 10.

In use, an athlete may place shoulder pads 80 on his or her body before donning the shoulder pad cover 10. Alternatively, the shoulder pad cover 10 may be placed on the shoulder pads 80 before the athlete places the shoulder pads 80 on his body. Shoulder pad straps 89, 90, may or may not be used to assist in securing the shoulder pads 80 to the athlete. The athlete places the shoulder pad cover 10 on his body, passing his head 94 through the torso opening 24 and neck opening 26, and passing his arms 96 through the right and left arm passages 28 and 30. When the shoulder pad cover 10 is placed on the shoulder pads 80, the torso opening 24 is pulled down over the left and right main arches 81 and 82 of the shoulder pads 80 such that the torso opening 24 fits around the abdomen 92 of the athlete extending to the waist of the athlete. With the shoulder pad cover 10 in this position, the left and right arches 81 and 82 of the shoulder pads 10 are substantially covered by the shoulder pad cover 10. Next, the right and left shoulder caps 83 and 84 of the shoulder pads 80 are tucked into the right and left shoulder pockets 44 and 54 of the shoulder pad cover 10. Thereafter, the right and left epaulettes 85 and 86 of the shoulder pads 80 are pulled through the epaulette passages 32, 34 of the shoulder pad cover 10. When properly positioned on the athlete, the shoulder pad cover 10 improves shoulder pad 80 fit and reduces slipping by pulling the shoulder pads into the human body from all angles. In addition, the shoulder pad covering 10 provides a protective barrier between the shoulder pads 80 and an outer jersey worn by the athlete.

Although the present invention has been described with respect to certain exemplary embodiments, it will be appreciated by those of skill in the art that other implementations and adaptations are possible. Moreover, there are advantages to individual advancements described herein that may be obtained without incorporating other aspects described above. Therefore, the spirit and scope of any appended claims should not be limited to the description of the exemplary embodiments contained herein.

What is claimed is:

1. A garment comprising: a torso portion including a left opening and a right opening, the left opening providing a left arm passage from an interior to an exterior of the garment and the right opening providing a right arm passage from the interior to the exterior of the garment, the left opening located in a left underarm area and left shoulder area of the torso portion, and the right opening located in a right underarm area and right shoulder area of the garment;

a left shoulder pocket connected to the torso portion above the left underarm area, the left shoulder pocket including an upper portion, a lower portion, and a pocket opening between the upper portion and the lower portion at a right side of the left shoulder pocket; the pocket opening facing the left opening of the torso portion; and a right shoulder pocket connected to the torso portion above the right underarm area, the right shoulder pocket including an upper portion, a lower portion, and a pocket opening between the upper portion and the lower portion at a left side of the right shoulder pocket, the pocket opening facing the right opening of the torso portion.

2. The garment of claim 1 further comprising a center opening included on the torso portion and providing a neck passage from the interior to the exterior of the garment.

3. The garment of claim 2 further comprising:

a second left opening providing an epaulette passage between the left shoulder pocket and the neck passage; and a second right opening providing an epaulette passage between the right shoulder pocket and the neck passage.

4. The garment of claim 3 further comprising athletic shoulder pads including a left main arch coupled to a right main arch, a left epaulette and a left shoulder cap coupled to the left main arch, a right epaulette and a right shoulder cap coupled to the right main arch, the left epaulette extending through the second left opening, the right epaulette extending through the second right opening, the left shoulder cap positioned in the left shoulder pocket, and the right shoulder cap positioned in the right shoulder pocket.

5. The garment of claim 1 further comprising athletic shoulder pads including a left shoulder cap and a right shoulder cap, the left shoulder cap positioned in the left shoulder pocket, and the right shoulder cap positioned in the left shoulder pocket.

6. The garment of claim 5 wherein the left shoulder cap is coupled to the right shoulder cap on the athletic shoulder pads.

7. The garment of claim 6, the athletic shoulder pads further including a left main arch coupled to a right main arch, the left shoulder cap coupled to the left main arch, and the right shoulder cap coupled to the right main arch such that the left shoulder cap is independently movable with respect to the right shoulder cap, the torso portion substantially covering the left main arch and the right main arch.

8. The garment of claim 7 further comprising gripping members provided on an interior of the torso portion, the gripping members engaging the left main arch and the right main arch of the athletic shoulder pads.

9. The garment of claim 7 wherein the torso portion is configured to extend below the left main arch and the right main arch in order to extend around an abdomen of a wearer without extending to a waist of the wearer.

10. The garment of claim 1 wherein the torso portion is comprised of compression fabric.

11. A method of securing shoulder pads to a wearer, the method comprising:

placing the shoulder pads on the shoulders of the wearer, the shoulder pads including a main portion, a left shoulder cap pivotably coupled to the main portion, and a right shoulder cap pivotably coupled to the main portion;

placing a shoulder pad cover over the shoulder pads such that the wearer's left arm extends through a left opening in the shoulder pad cover, the wearer's right arm extends through a right opening in the shoulder pad cover, and a torso portion of the shoulder pad cover substantially covers the main portion of the shoulder pads;

inserting the left shoulder cap of the shoulder pads through a left pocket opening and into a left shoulder pocket of the shoulder pad cover, the left shoulder pocket including an upper portion and a lower portion with the left pocket opening between the upper portion and the lower portion; and inserting a right shoulder cap of the shoulder pads through a right pocket opening and into the right shoulder pocket of the shoulder pad cover, the right shoulder pocket including an upper portion and a lower portion with the right pocket opening between the upper portion and the lower portion.

12. The method of claim 11 further comprising:

inserting a left epaulette of the shoulder pads through a left epaulette opening in the shoulder pad cover, and inserting a right epaulette of the shoulder pads through a right epaulette opening in the shoulder pad cover.

13. The method of claim 11 wherein the shoulder pad cover is comprised of a compression fabric such that placing a shoulder pad cover over the shoulder pads includes stretching the torso portion of the shoulder pad cover over the main portion of the shoulder pads.

14. The method of claim 11 wherein placing the shoulder pad cover over the shoulder pads includes pulling the torso portion of the shoulder pad cover past the main portion of the shoulder pads and around an abdomen of the wearer.

15. A garment arrangement comprising:

shoulder pads including a main portion, a left shoulder cap pivotably coupled to the main portion, and a right shoulder cap pivotably coupled to the main portion; and a shoulder pad cover comprising:

a torso portion including a torso opening, a neck opening, a left arm opening, and a right arm opening;

a left shoulder pocket connected to the torso portion adjacent to the left arm opening, the left shoulder pocket including an upper portion, a lower portion, and an opening configured to receive the left shoulder cap of the shoulder pads between the upper portion and the lower portion; and a right shoulder pocket connected to the torso portion adjacent to the right arm opening, the right shoulder pocket including an upper portion, a lower portion, and an opening configured to receive the right shoulder cap of the shoulder pads between the upper portion and the lower portion.

16. The garment arrangement of claim 15, the shoulder pads further comprising a left epaulette and a right epaulette, the torso portion including a right epaulette opening between the neck and the right shoulder pocket and a left epaulette opening between the neck and the left shoulder pocket, the right epaulette opening configured to receive the right epaulette and the left epaulette opening configured to receive the left epaulette.

17. The garment arrangement of claim 15 further comprising gripping members provided on an interior of the torso portion, the gripping members engaging the main portion of the shoulder pads.

18. The garment arrangement of claim 15 wherein the torso portion is configured to extend below the main portion of the shoulder pads and extend around an abdomen of a wearer without extending to a waist of the wearer.

19. The garment arrangement of claim 15 wherein the torso portion is comprised of compression fabric.

20. The method of claim 11 wherein placing the shoulder pad cover over the shoulder pads, inserting the left shoulder cap of the shoulder pads through the left pocket opening, and inserting the right shoulder cap of the shoulder pads through the right pocket opening occurs before placing the shoulder pads on the shoulders of the wearer.

* * * * *